US011050174B2

(12) United States Patent
Midorikawa

(10) Patent No.: US 11,050,174 B2
(45) Date of Patent: Jun. 29, 2021

(54) ELECTRIC CONNECTOR ASSEMBLY

(71) Applicant: HIROSE ELECTRIC CO., LTD., Tokyo (JP)

(72) Inventor: Kazuya Midorikawa, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/885,678

(22) Filed: May 28, 2020

(65) Prior Publication Data

US 2020/0381851 A1 Dec. 3, 2020

(30) Foreign Application Priority Data

May 31, 2019 (JP) ..... JP2019-102780

(51) Int. Cl.

| | |
|---|---|
| ***H01R 12/71*** | (2011.01) |
| ***H01R 13/629*** | (2006.01) |
| ***H01R 13/502*** | (2006.01) |
| ***H01R 13/42*** | (2006.01) |
| ***H01R 12/52*** | (2011.01) |

(52) U.S. Cl.
CPC ..... *H01R 12/716* (2013.01); *H01R 12/52* (2013.01); *H01R 13/42* (2013.01); *H01R 13/502* (2013.01); *H01R 13/629* (2013.01)

(58) Field of Classification Search
CPC ..... H01R 12/716; H01R 12/52; H01R 13/42; H01R 13/502; H01R 13/629
See application file for complete search history.

(56) References Cited

U.S. PATENT DOCUMENTS

| | | | | |
|---|---|---|---|---|
| 9,716,326 | B2 * | 7/2017 | Tamai | H01R 12/73 |
| 10,283,886 | B2 * | 5/2019 | Hasegawa | H01R 13/6315 |
| 10,673,164 | B2 * | 6/2020 | Horii | H01R 13/055 |
| 10,673,181 | B2 * | 6/2020 | Horii | H01R 12/727 |
| 10,804,630 | B2 * | 10/2020 | Horii | H01R 12/737 |
| 10,931,045 | B2 * | 2/2021 | Aoki | H01R 13/6315 |
| 2008/0207014 | A1 * | 8/2008 | Takeuchi | H01R 12/716 439/74 |
| 2010/0267287 | A1 * | 10/2010 | Ishikawa | H01R 13/20 439/700 |
| 2011/0045679 | A1 * | 2/2011 | Yu | H01R 12/716 439/66 |
| 2016/0172780 | A1 * | 6/2016 | Tamai | H01R 12/73 439/733.1 |
| 2020/0381851 | A1 * | 12/2020 | Midorikawa | H01R 13/631 |
| 2021/0111504 | A1 * | 4/2021 | Kobayashi | H01R 12/716 |

FOREIGN PATENT DOCUMENTS

JP 2016-012567 1/2016

* cited by examiner

*Primary Examiner* — Abdullah A Riyami
*Assistant Examiner* — Nader J Alhawamdeh
(74) *Attorney, Agent, or Firm* — Rankin, Hill & Clark LLP

(57) ABSTRACT

When an electric connector assembly is in a connector fitting state, a distance from a receptacle protruding wall first end surface on one end side of a receptacle housing in a longitudinal direction to an inner surface of a receptacle end wall on the other end side and a distance from a plug end wall first inner surface on one end side of a plug housing in the longitudinal direction to an outer surface of a plug end wall on the other end side are equal to each other at an optional position in an upper-lower direction.

7 Claims, 6 Drawing Sheets

ELECTRIC CONNECTOR ASSEMBLY

CROSS-REFERENCE TO RELATED APPLICATION

This application claims priority from Japanese Patent Application No. 2019-102780 filed with the Japan Patent Office on May 31, 2019, the entire content of which is hereby incorporated by reference.

BACKGROUND

1. Technical Field

One aspect of the present disclosure relates to an electric connector assembly.

2. Related Art

An electric connector assembly has, for example, a receptacle connector arranged on a mounting surface of a circuit board and a plug connector arranged on another circuit board. An upper-lower direction as a direction in which the circuit boards face each other is a connector insertion/detachment direction. The plug connector is, from above, fitted in and connected to the receptacle connector. Such an electric connector assembly is, for example, disclosed in JP-A-2016-012567. In a housing (a receptacle housing) of the receptacle connector among the receptacle connector and the plug connector forming the electric connector assembly described in JP-A-2016-012567, an annular space forms a receiving portion for receiving a fitting portion of the plug connector. Such an annular space opens upward between an inner surface of a receptacle peripheral wall standing from a peripheral portion of a bottom wall facing the mounting surface of the circuit board and an outer surface of a receptacle protruding wall standing from the bottom wall in the receptacle peripheral wall. On the other hand, in a housing (a plug housing) of the plug connector, a plug peripheral wall standing from a bottom wall at a right angle to a mounting surface of another circuit board forms the fitting portion. The fitting portion is, from above, fitted in the receiving portion of the receptacle housing.

Outer surfaces (end surfaces) positioned on one end side and the other end side of the receptacle protruding wall in a longitudinal direction of the receptacle housing form inclined surfaces. Such an inclined surface is, across the entire area in the upper-lower direction, inclined toward a receptacle end wall (among wall portions forming the receptacle peripheral wall, wall portions positioned on one end side and the other end side in the longitudinal direction) of the receptacle housing as extending downward. Moreover, an inner surface of the receptacle end wall facing the inclined surface in the longitudinal direction forms a vertically-standing flat surface (a surface at a right angle to the longitudinal direction) without inclination with respect to the upper-lower direction.

On the other hand, an inner surface of a plug end wall (among wall portions forming the plug peripheral wall (the fitting portion), wall portions positioned on one end side and the other end side in the longitudinal direction) of the plug housing forms an inclined surface in the state of fitting in the receptacle connector. Such an inclined surface extends, across the entire area in the upper-lower direction, along an outer surface of the receptacle end wall at the same inclination angle as that of such an outer surface. Moreover, an outer surface of the plug end wall forms a vertically-standing flat surface (a surface at a right angle to the longitudinal direction) without inclination with respect to the upper-lower direction.

In JP-A-2016-012567, the outer surface of the receptacle protruding wall and the inner surface of the plug end wall form the surfaces inclined at the same angle as described above. That is, the outer surface of the receptacle protruding wall and the inner surface of the plug end wall have, by an amount corresponding to inclination, greater areas than those in a case where these surfaces are formed as non-inclined surfaces parallel to the upper-lower direction. Thus, when the plug connector is shifted from a regular position to the other end side in the longitudinal direction in a connector fitting state, the inner surface of the plug end wall on one end side contacts (surface-contacts) the outer surface of the receptacle protruding wall on one end side at a large contact area. Consequently, contact force (contact pressure) generated at the plug end wall and the receptacle protruding wall can be decreased.

SUMMARY

An electric connector assembly includes: a receptacle connector arranged on a mounting surface of a circuit board; and a plug connector arranged on another circuit board. The plug connector is, from above, fitted in and connected to the receptacle connector, an upper-lower direction in which the circuit boards face each other being taken as a connector insertion/detachment direction, the receptacle connector includes a receptacle housing, the receptacle housing has a peripheral wall and a receptacle protruding wall standing upward from a bottom wall in the peripheral wall, the peripheral wall is formed by a pair of receptacle side walls standing upward from a peripheral portion of the bottom wall facing the mounting surface of the circuit board and extending in a longitudinal direction of the receptacle housing and a pair of receptacle end walls coupling, in a transverse direction at a right angle to the longitudinal direction, end portions of the pair of receptacle side walls in the longitudinal direction, a space surrounded by an inner peripheral surface of the peripheral wall and an outer peripheral surface of the receptacle protruding wall is formed as a receiving portion for receiving the plug connector from above, the plug connector includes a plug housing, the plug housing has a fitting portion to be fitted in the receiving portion from above, the fitting portion has a pair of plug side walls extending in the longitudinal direction and a pair of plug end walls coupling, in the transverse direction, end portions of the pair of plug side walls in the longitudinal direction, each of outer surfaces of the receptacle protruding wall positioned on one end side and the other end side in the longitudinal direction has a receptacle protruding wall first end surface positioned on an upper end side and a receptacle protruding wall second end surface positioned below the receptacle protruding wall first end surface, the receptacle protruding wall first end surface is inclined with respect to the upper-lower direction toward an inner surface side of a corresponding one of the receptacle end walls as extending downward, the receptacle protruding wall second end surface is inclined at a smaller inclination angle than that of the receptacle protruding wall first end surface, or extends parallel to the upper-lower direction, in a connector fitting state in which the plug connector is fitted in the receptacle connector, an inner surface of each plug end wall has a plug end wall first inner surface positioned in an area corresponding to the receptacle protruding wall first end surface and a plug end wall second inner surface positioned in an area corresponding to the receptacle protruding wall second end surface, the plug end wall first inner surface is inclined to extend along the receptacle protruding wall first end surface, the plug end wall second inner surface is inclined to separate from the receptacle protruding wall second end surface as extending downward, and in the connector fitting state, a distance from the receptacle protruding wall first end surface on one end side of the receptacle housing in the longitudinal direction to the inner surface of the receptacle end wall on the other end side and a distance from the plug end wall first inner surface on one end side of the plug housing in the longitudinal direction to an outer surface of the plug end wall on the other end side are equal to each other at an optional position in the upper-lower direction.

DETAILED DESCRIPTION

Figure 1:
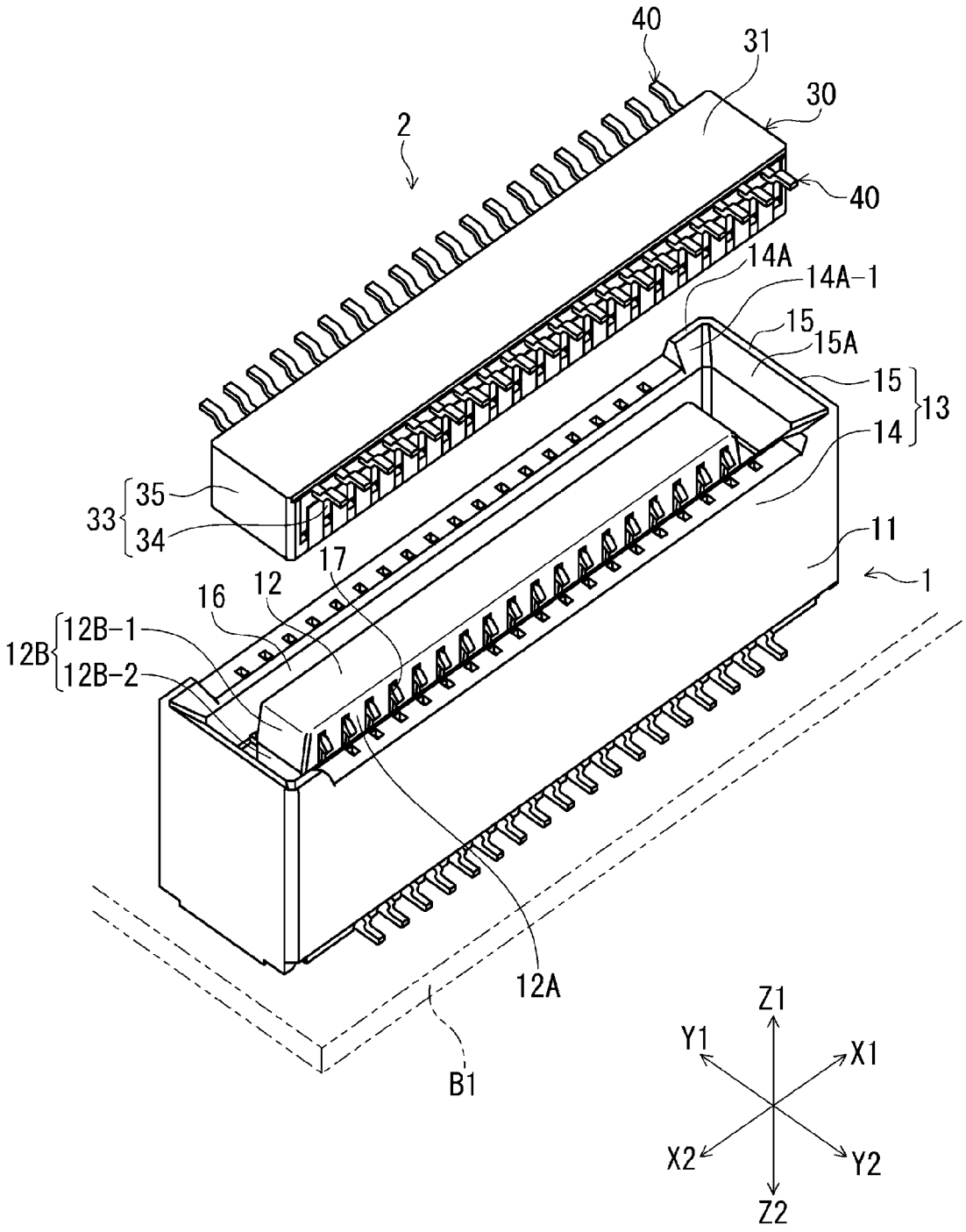
FIG. 1 is a perspective view illustrating a receptacle connector and a plug connector in a state right before fitting, the receptacle connector and the plug connector forming an electric connector assembly according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

However, in JP-A-2016-012567, it is unclear whether or not the outer surface of the plug end wall also contacts the inner surface of the receptacle end wall on the other end side when the inner surface of the plug end wall contacts the outer surface of the receptacle protruding wall on one end side in the longitudinal direction. If the outer surface of the plug end wall does not contact the inner surface of the receptacle end wall on the other end side, the force of contact between the housings is received only by the position of contact between the inner surface of the plug end wall and the outer surface of the receptacle protruding wall on one end side. For this reason, such contact force becomes great because the contact force cannot be dispersed. As a result, there is a probability that the plug end wall and the receptacle protruding wall on one end side are damaged.

Moreover, in JP-A-2016-012567, in the connector fitting state, the inner surface of the plug end wall and the outer surface of the receptacle protruding wall can surface-contact each other across the entire areas of the plug end wall and the receptacle protruding wall in the upper-lower direction. Thus, when the plug connector is wrenched in the longitudinal direction upon connector detachment, a lower portion of the plug end wall contacts a lower portion of the receptacle protruding wall every time the plug connector is wrenched. As a result, concentration of the contact force on these lower portions is caused, and for this reason, there is a probability that the plug end wall and the receptacle protruding wall are also damaged upon connector detachment.

One object of the present disclosure is to provide the following electric connector assembly. In this electric connector assembly, damage of a plug end wall and a receptacle protruding wall can be reduced upon either of a connector fitting state or connector detachment.

According to an embodiment of the present disclosure, an electric connector assembly (this electric connector assembly) includes: a receptacle connector arranged on a mounting surface of a circuit board; and a plug connector arranged on another circuit board. The plug connector is, from above, fitted in and connected to the receptacle connector, an upper-lower direction in which the circuit boards face each other being taken as a connector insertion/detachment direction, the receptacle connector includes a receptacle housing, the receptacle housing has a peripheral wall and a receptacle protruding wall standing upward from a bottom wall in the peripheral wall, the peripheral wall is formed by a pair of receptacle side walls standing upward from a peripheral portion of the bottom wall facing the mounting surface of the circuit board and extending in a longitudinal direction of the receptacle housing and a pair of receptacle end walls coupling, in a transverse direction at a right angle to the longitudinal direction, end portions of the pair of receptacle side walls in the longitudinal direction, a space surrounded by an inner peripheral surface of the peripheral wall and an outer peripheral surface of the receptacle protruding wall is formed as a receiving portion for receiving the plug connector from above, the plug connector includes a plug housing, the plug housing has a fitting portion to be fitted in the receiving portion from above, the fitting portion has a pair of plug side walls extending in the longitudinal direction and a pair of plug end walls coupling, in the transverse direction, end portions of the pair of plug side walls in the longitudinal direction.

Further, in the electric connector assembly, each of outer surfaces of the receptacle protruding wall positioned on one end side and the other end side in the longitudinal direction has a receptacle protruding wall first end surface positioned on an upper end side and a receptacle protruding wall second end surface positioned below the receptacle protruding wall first end surface, the receptacle protruding wall first end surface is inclined with respect to the upper-lower direction toward an inner surface side of a corresponding one of the receptacle end walls as extending downward, the receptacle protruding wall second end surface is inclined at a smaller inclination angle than that of the receptacle protruding wall first end surface, or extends parallel to the upper-lower direction, in a connector fitting state in which the plug connector is fitted in the receptacle connector, an inner surface of each plug end wall has a plug end wall first inner surface positioned in an area corresponding to the receptacle protruding wall first end surface and a plug end wall second inner surface positioned in an area corresponding to the receptacle protruding wall second end surface, the plug end wall first inner surface is inclined to extend along the receptacle protruding wall first end surface, the plug end wall second inner surface is inclined to separate from the receptacle protruding wall second end surface as extending downward, and in the connector fitting state, a distance from the receptacle protruding wall first end surface on one end side of the receptacle housing in the longitudinal direction to the inner surface of the receptacle end wall on the other end side and a distance from the plug end wall first inner surface on one end side of the plug housing in the longitudinal direction to an outer surface of the plug end wall on the other end side are equal to each other at an optional position in the upper-lower direction.

In the present electric connector assembly, when the connectors are in the fitting state, the distance from the receptacle protruding wall first end surface on one end side of the receptacle housing in the longitudinal direction to the inner surface of the receptacle end wall on the other end side and the distance from the plug end wall first inner surface on one end side of the plug housing in the longitudinal direction to the outer surface of the plug end wall on the other end side are equal to each other at the optional position in the upper-lower direction. Thus, in the connector fitting state, when the position of the plug connector with respect to the receptacle connector is shifted from a regular position to the other end side in the longitudinal direction, the plug end wall first inner surface contacts the receptacle protruding wall first end surface on one end side. Further, at the same time, the outer surface of the plug end wall also contacts the inner surface of the receptacle end wall on the other end side. As a result, the force of contact between the plug housing and the receptacle housing can be received dispersedly by both positions on one end side and the other end side. Thus, in the present electric connector assembly, the force received by each position is smaller as compared to a typical case where the force of contact between housings is received by a single position. Thus, it is less likely to damage the plug end wall and the receptacle protruding wall.

Moreover, in the present electric connector assembly, the receptacle protruding wall second end surface is inclined with respect to the upper-lower direction at a smaller inclination angle than that of the receptacle protruding wall first end surface, or extends parallel to the upper-lower direction. Further, the plug end wall second inner surface is inclined to separate from the receptacle protruding wall second end surface in the longitudinal direction as extending downward. Thus, in the connector fitting state, a clearance becoming larger toward a lower side is formed between the receptacle protruding wall second end surface and the plug end wall second inner surface. On this point, when the plug connector is wrenched upon connector detachment, a lower portion of the plug end wall is greatly displaced (moved) in the longitudinal direction. Even in this case, in the present electric connector assembly, the above-described great clearance is formed, and therefore, the receptacle protruding wall second end surface and the plug end wall second inner surface are less likely to contact each other. Thus, it is less likely to damage the plug end wall and the receptacle protruding wall.

In the electric connector assembly, each plug end wall may have a projecting portion protruding toward the receptacle protruding wall in an area corresponding to an intermediate area of the receptacle protruding wall of the receptacle housing in the transverse direction in the connector fitting state, and the plug end wall first inner surface and the plug end wall second inner surface may be formed at the projecting portion.

In this configuration, the plug end wall first inner surface and the plug end wall second inner surface are formed at the projecting portion. In this case, even when the plug end wall first inner surface contacts the receptacle protruding wall first end surface in the connector fitting state, a clearance is formed between the inner surface of the plug end wall and the outer surface of the receptacle protruding wall on each side of the projecting portion in the transverse direction. Thus, in the connector fitting state, even in a case where the external force of causing rotation about an axis extending in the upper-lower direction acts on the plug connector, the inner surface of the plug end wall is less likely to contact the outer surface of the receptacle protruding wall on each side of the projecting portion. Consequently, it is less likely to damage the plug end wall and the receptacle protruding wall.

In the electric connector assembly, the projecting portion may be formed to have a smaller dimension in a connector width direction than that of each outer surface of the receptacle protruding wall.

Further, in the electric connector assembly, the inner surface of each plug end wall may have plug end wall third inner surfaces on both sides of the projecting portion in the connector width direction, and the plug end wall third inner surfaces may be, in the connector fitting state, positioned outside the plug end wall first inner surface and the plug end wall second inner surface in the longitudinal direction.

Moreover, in the electric connector assembly, each plug end wall third inner surface is, in the connector fitting state, positioned with a clearance in the longitudinal direction from a corresponding one of the outer surfaces of the receptacle protruding wall. With such a clearance, even in a case where the external force of causing rotation about the axis extending in the connector insertion/detachment direction acts on the plug connector in the connector fitting state, the plug end wall third inner surface is less likely to contact the outer surface of the receptacle protruding wall. Thus, deformation of the receptacle protruding wall is favorably reduced.

As described above, in the present electric connector assembly, when the position of the plug connector with respect to the receptacle connector is, in the connector fitting state, shifted from the regular position to the other end side in the longitudinal direction of the connector, the plug end wall first inner surface contacts the receptacle protruding wall first end surface on one end side. Further, at the same time, the outer surface of the plug end wall also contacts the inner surface of the receptacle end wall on the other end side. As a result, the force of contact between the plug housing and the receptacle housing can be received dispersedly by both positions on one end side and the other end side. Thus, contact stress generated at each position is smaller as compared to the typical case where the above-described contact force is received by the single position. Thus, it is less likely to damage the plug end wall and the receptacle protruding wall.

Moreover, in the present disclosure, in the connector fitting state, the clearance along the longitudinal direction is formed between the receptacle protruding wall second end surface and the plug end wall second inner surface. Thus, when the plug connector is wrenched upon connector detachment, the receptacle protruding wall second end surface and the plug end wall second inner surface are less likely to contact each other. As a result, it is less likely to damage the plug end wall and the receptacle protruding wall.

Hereinafter, an embodiment of the present disclosure will be described based on the attached drawings.

Figure 2A:
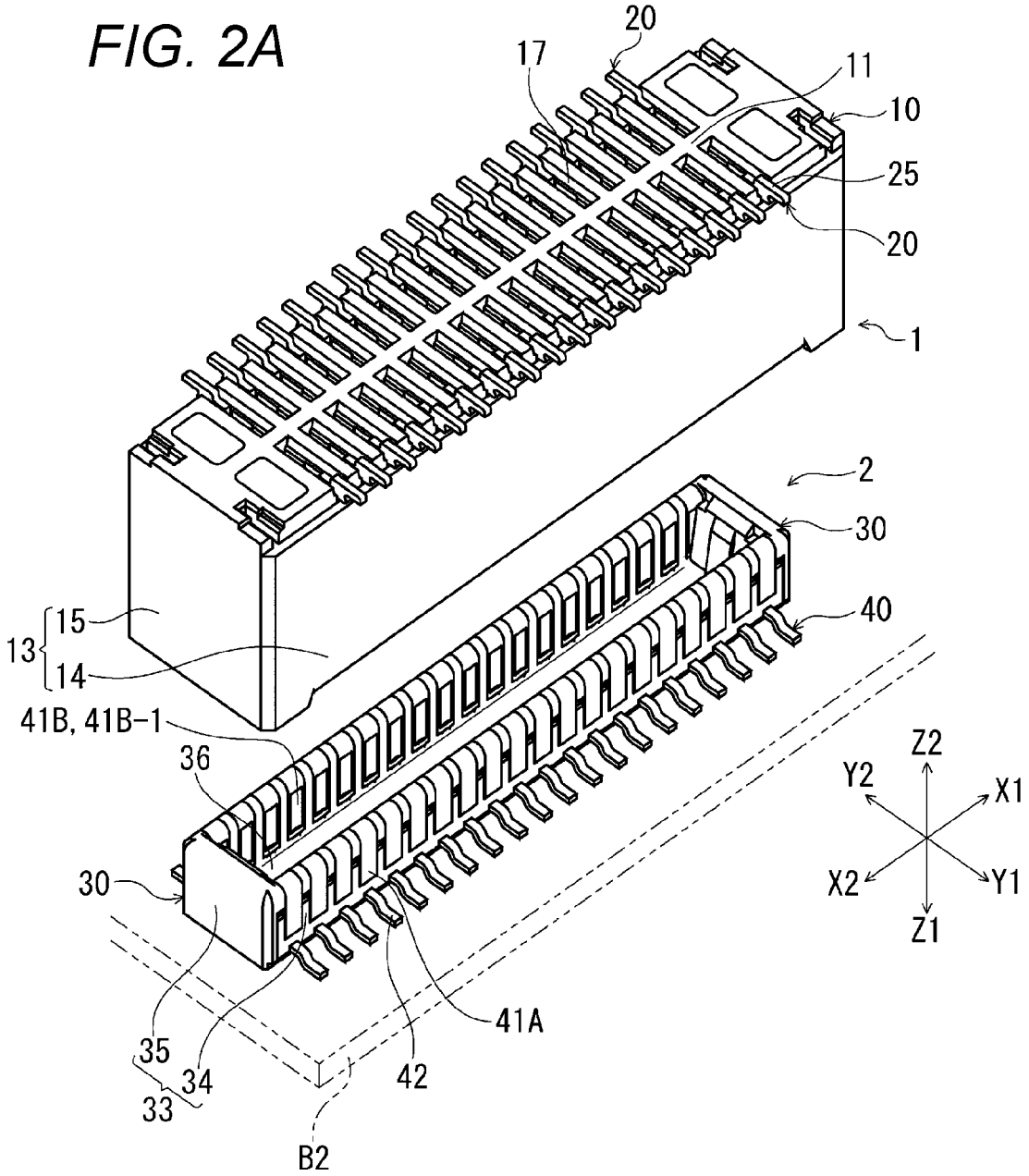
FIG. 2A is a perspective view illustrating the electric connector assembly illustrated in FIG. 1 in a vertically-flipped state.
Figure 2B:
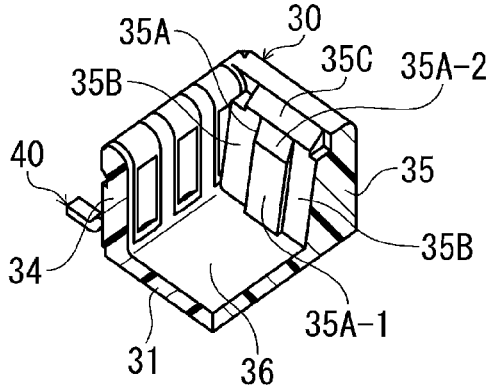
FIG. 2B is a perspective sectional view illustrating only part of the plug connector illustrated in FIG. 2A.

FIG. 1 is a perspective view illustrating a receptacle connector 1 and a plug connector 2 as a partner connector of the receptacle connector 1 in a state right before fitting, the receptacle connector 1 and the plug connector 2 forming an electric connector assembly according to the present embodiment. FIG. 2A is a perspective view illustrating the electric connector assembly illustrated in FIG. 1 in a vertically-flipped state, and FIG. 2B is a perspective sectional view illustrating only part of the plug connector 2 illustrated in FIG. 2A.

The receptacle connector 1 and the plug connector 2 in the present embodiment are each circuit board electric connectors arranged on mounting surfaces of different circuits boards (a circuit board B1 illustrated in FIG. 1 and a circuit board B2 illustrated in FIG. 2A). The receptacle connector 1 and the plug connector 2 form the electric connector assembly configured such that an upper-lower direction (a Z-axis direction in FIGS. 1 and 2A) at a right angle to the surface of each circuit board is a connector insertion/detachment direction. In the connector insertion/detachment direction, a Z2 direction is the direction of fitting the plug connector 2 in the receptacle connector 1, and a Z1 direction is a detachment direction of the plug connector 2.

The receptacle connector 1 and the plug connector 2 have shapes symmetrical with respect to a center position in each of a terminal array direction and a connector width direction.

Of the receptacle connector 1 and the plug connector 2, the receptacle connector 1 will be first described. As illustrated in FIGS. 1 and 2A, the receptacle connector 1 has a receptacle housing 10 having a substantially rectangular parallelepiped outer shape and multiple receptacle terminals 20 held by the receptacle housing 10. The multiple receptacle terminals 20 are arrayed in two lines in the receptacle housing 10, a longitudinal direction (an X-axis direction) of the receptacle housing 10 being taken as the terminal array direction. As seen from FIG. 1, the receptacle connector 1 is arranged and mounted on the circuit board B1.

The receptacle housing 10 is, for example, made of an electric insulating material such as resin. As seen from FIG. 1, in the receptacle housing 10, the X-axis direction in a plane (an X-Y plane) parallel to the mounting surface of the circuit board B1 is the longitudinal direction, and a Y-axis direction at a right angle to the longitudinal direction is a transverse direction. Hereinafter, the X-axis direction will be referred to as the "terminal array direction," and the Y-axis direction will be referred to as the "connector width direction." The receptacle housing 10 has a receptacle bottom wall 11 facing the mounting surface of the circuit board B1, a receptacle protruding wall 12, and a frame-shaped receptacle peripheral wall 13. The receptacle protruding wall 12 stands upward (the Z1 direction) from the receptacle bottom wall 11 as viewed in FIG. 1, and extends in the terminal array direction. The frame-shaped receptacle peripheral wall 13 stands upward from a peripheral portion of the receptacle bottom wall 11, and surrounds the receptacle protruding wall 12.

Figure 3:
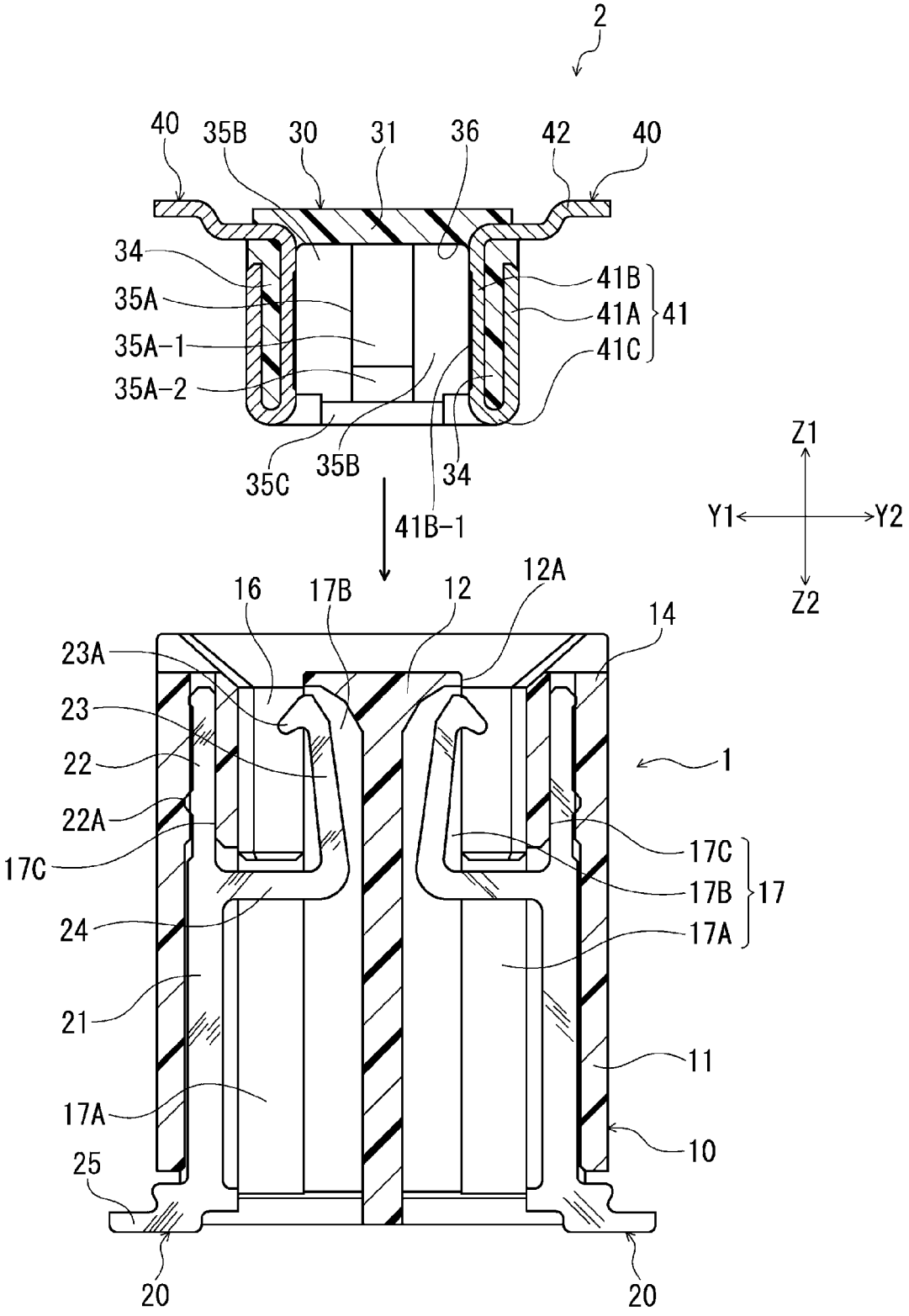
FIG. 3 is a sectional view of the electric connector assembly illustrated in FIG. 1 in a plane at a right angle to a terminal array direction, and illustrates the section at the positions of terminals in the terminal array direction.

FIG. 3 is a sectional view of the electric connector assembly illustrated in FIG. 1 in a plane (a Y-Z plane) at a right angle to the terminal array direction. FIG. 3 illustrates the section at the positions of the receptacle terminals 20 and later-described plug terminals 40 in the terminal array direction. As seen from FIG. 3, the receptacle bottom wall 11 is formed to have a dimension corresponding to the area of the substantially lower half of the receptacle housing 10 in the upper-lower direction.

As seen from FIG. 1, the receptacle protruding wall 12 is in an island shape in the receptacle peripheral wall 13, and extends in the terminal array direction. The receptacle peripheral wall 13 has a pair of receptacle side walls 14 extending in the terminal array direction and a pair of receptacle end walls 15. The pair of receptacle end walls 15 extends in the connector width direction, and couples end portions of the pair of receptacle side walls 14. An annular space formed between an outer peripheral surface of the receptacle protruding wall 12 and an inner peripheral surface of the receptacle peripheral wall 13 surrounding the receptacle protruding wall 12 opens upward. Such an annular space is formed as a receiving portion 16 for receiving, from above, a corresponding fitting portion (a later-described plug peripheral wall 33) of the plug connector 2.

The outer peripheral surface of the receptacle protruding wall 12 forming the receiving portion 16 has a pair of side surfaces 12A and a pair of end surfaces 12B. The pair of side surfaces 12A is at a right angle to the connector width direction, and extends in the terminal array direction. The pair of end surfaces 12B is positioned on both end sides in the terminal array direction.

Figure 4A:
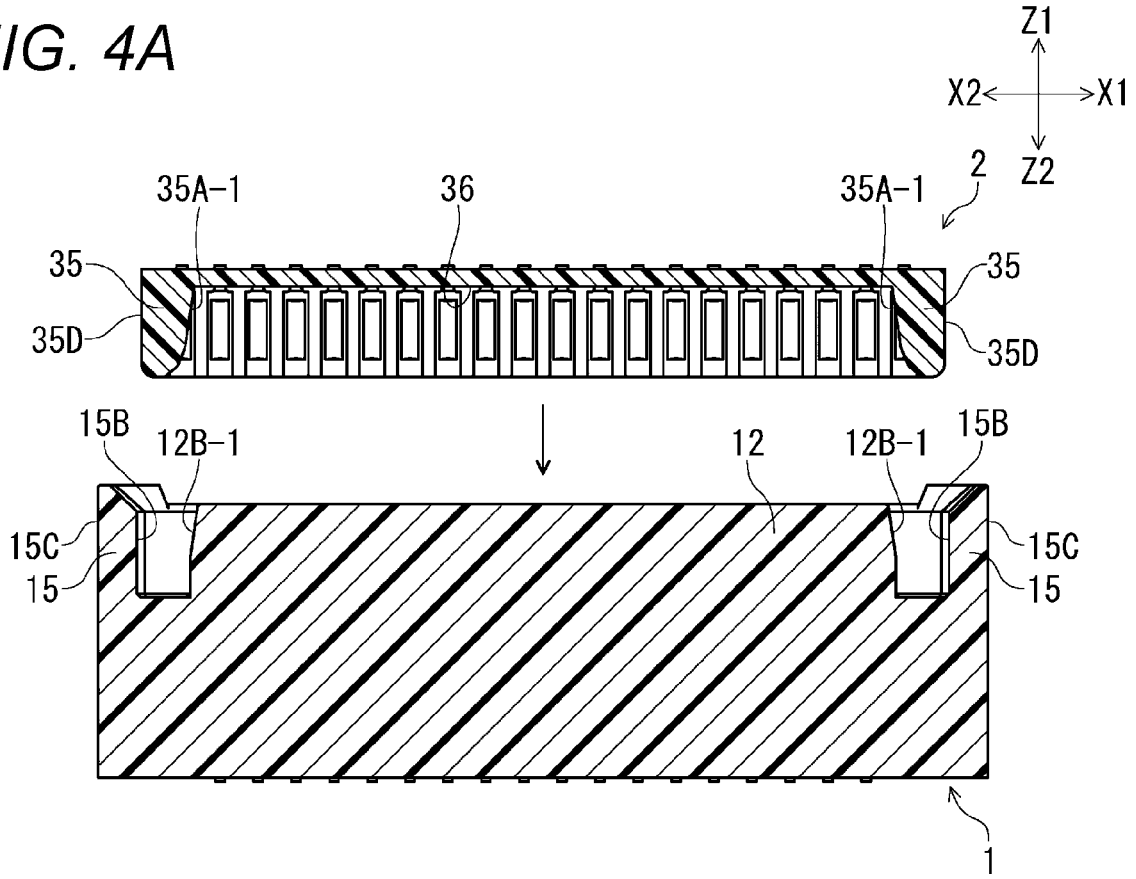
FIG. 4A is a sectional view of the electric connector assembly illustrated in FIG. 1 in a plane at a right angle to a connector width direction and illustrates the section at a center position in the connector width direction.
Figure 4B:
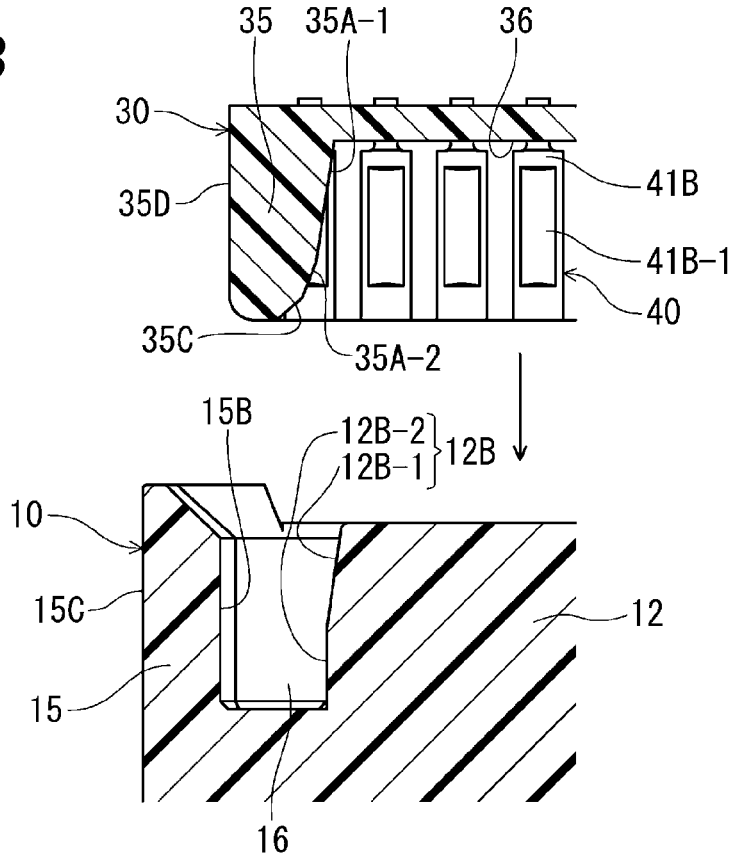
FIG. 4B is an enlarged sectional view of an end portion, which is positioned on one end side in the terminal array direction, of the connector assembly illustrated in FIG. 4A.

FIG. 4A is a sectional view of the electric connector assembly illustrated in FIG. 1 in a plane (an X-Z plane) at a right angle to the connector width direction, and illustrates a section at the center position in the connector width direction. For the electric connector assembly, i.e., the receptacle connector 1 and the plug connector 2, an X2 side in the terminal array direction (the X-axis direction) will be, in the present embodiment, referred to as "one end side," and an X1 side will be referred to as the "other end side," for the sake of convenience in description. Note that in the present embodiment, the X2 side will be referred to as "one end side," and the X1 side will be referred to as the "other end side." Instead, in a case where the X1 side is referred to as "one end side," the X2 side will be referred to as the "other end side." FIG. 4B is an enlarged sectional view of an end portion of the electric connector assembly illustrated in FIG. 4A, the end portion being positioned on one end side in the terminal array direction.

Figure 5A:
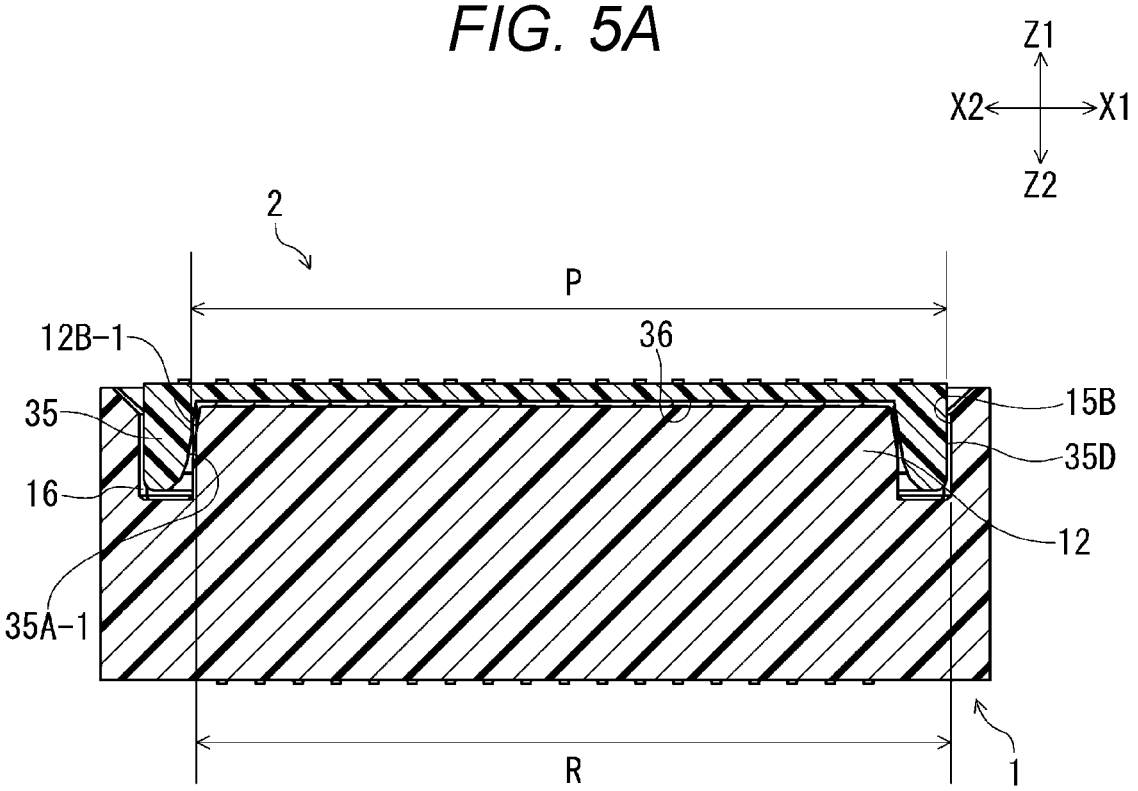
FIG. 5A is a sectional view of the electric connector assembly illustrated in FIG. 4A in a connector fitting state.
Figure 5B:
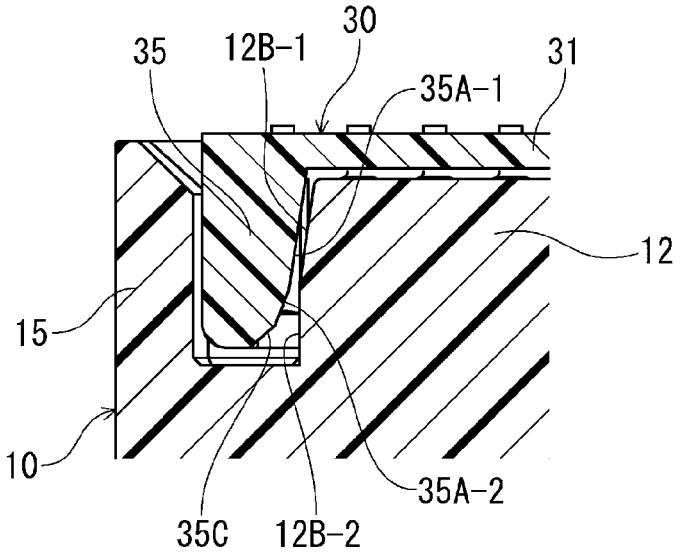
FIG. 5B is an enlarged sectional view of one end side of the connector assembly illustrated in FIG. 5A in the terminal array direction.
Figure 6:
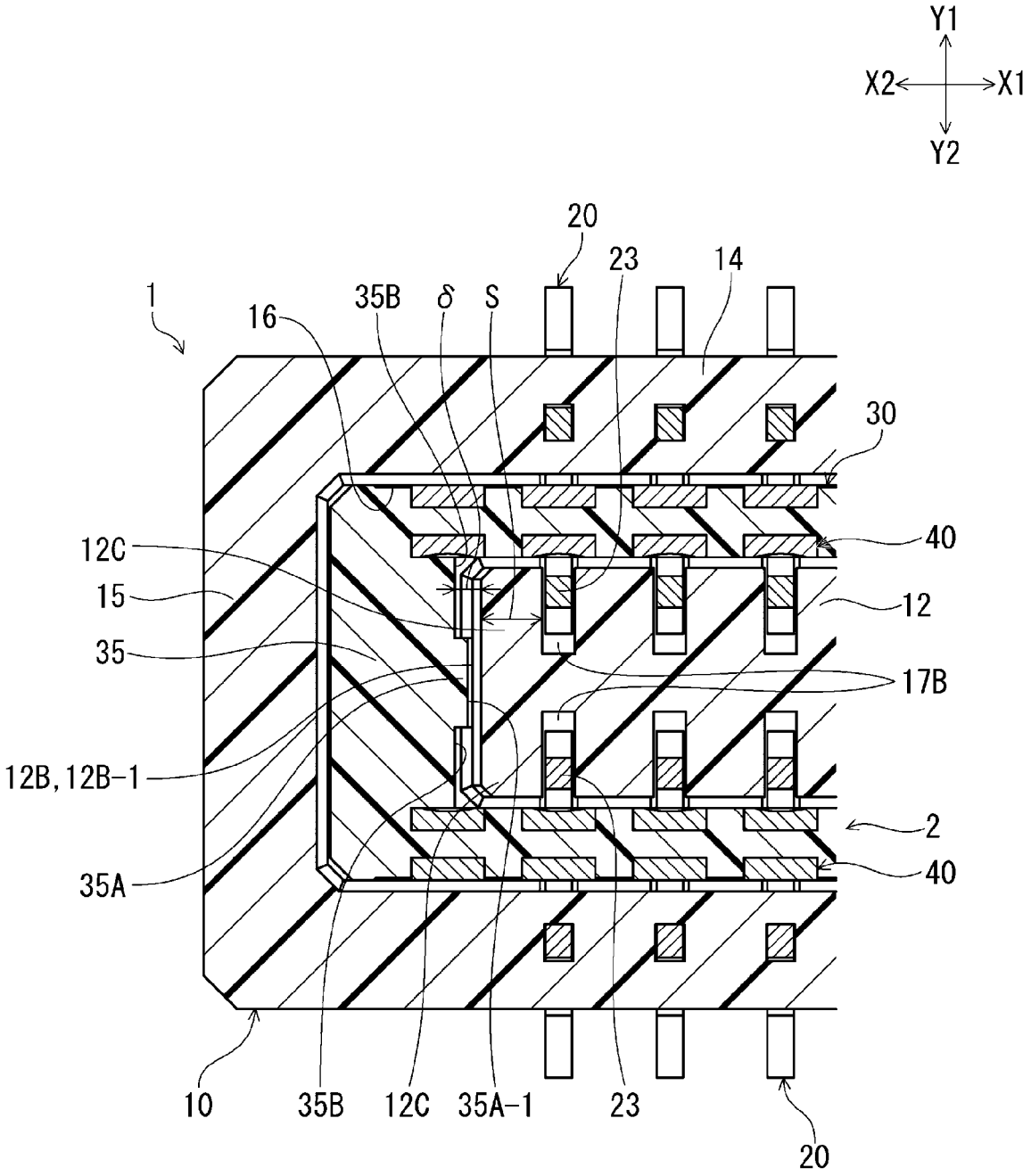
FIG. 6 is a sectional view of the connector assembly in the connector fitting state in a plane at a right angle to an upper-lower direction as viewed from above, and illustrates the section at an intermediate position of a receptacle protruding wall of the receptacle connector in the upper-lower direction.

Moreover, FIG. 5A is a sectional view of the electric connector assembly illustrated in FIG. 4A in a connector fitting state. FIG. 5B is an enlarged sectional view of one end side of the connector assembly illustrated in FIG. 5A in the terminal array direction. FIG. 6 is a sectional view of the connector assembly in the connector fitting state in the plane (the X-Y plane) at a right angle to the upper-lower direction as viewed from above, and illustrates the section at an intermediate position of the receptacle protruding wall 12 of the receptacle connector in the upper-lower direction.

Next, the end surface of the receptacle protruding wall 12 will be described. The receptacle connector 1 has the symmetrical shape with respect to the center position in the terminal array direction, and has the same shape between one end side and the other end side. Thus, only one end side will be described herein with reference to FIG. 4B, and description of the other end side will be omitted. As seen from FIG. 4B, the end surface 12B of the receptacle protruding wall 12 has a receptacle protruding wall first end surface 12B-1 positioned on an upper end side and a receptacle protruding wall second end surface 12B-2 positioned below the receptacle protruding wall first end surface 12B-1. As seen from FIG. 4B, the receptacle protruding wall first end surface 12B-1 is inclined with respect to the upper-lower direction toward the side of an inner surface 15B of the receptacle end wall 15 positioned on one end side, i.e., toward the X2 side, as extending downward (the Z2 direction). Moreover, the receptacle protruding wall second end surface 12B-2 extends parallel to the upper-lower direction without inclination.

As seen from FIGS. 1, 3, 4A, and 4B, the receptacle side wall 14 has side guide portions 14A at both end positions outside a terminal array area in the terminal array direction, i.e., outside the area of the receptacle protruding wall 12. The side guide portion 14A extends upward beyond an upper surface of the receptacle protruding wall 12. The side guide portion 14A has a side guide surface 14A-1 inclined inward (a direction toward the receiving portion 16) in the connector width direction as extending downward. The side guide portion 14A is configured such that upon the start of connector fitting, the plug connector 2 is guided toward the receiving portion 16 along the connector width direction by the side guide surface 14A-1.

As seen from FIGS. 1, 3, 4A, and 4B, the receptacle end wall 15 is formed with an end guide portion 15A extending upward beyond the upper surface of the receptacle protruding wall 12. The end guide portion 15A has an end guide surface 15A-1 inclined inward (a direction toward the receiving portion 16) in the terminal array direction as extending downward. The end guide portion 15A is configured such that upon the start of connector fitting, the plug connector 2 is guided toward the receiving portion 16 along the terminal array direction by the end guide surface 15A-1. Moreover, as seen from FIG. 4B, at the receptacle end wall 15, both of the inner surface 15B forming the receiving portion 16 and an outer surface 15C positioned on the opposite side of the inner surface 15B form surfaces parallel to the upper-lower direction, i.e., surfaces at a right angle to the terminal array direction.

At the receptacle housing 10, terminal holding grooves 17 for housing and holding the receptacle terminals 20 are formed at equal intervals along the terminal array direction. As seen from FIG. 3, the terminal holding groove 17 has a lower groove 17A formed at the receptacle bottom wall 11, an inner groove 17B formed at the receptacle protruding wall 12, and an outer groove 17C formed at the receptacle side wall 14. The lower groove 17A extends to penetrate the receptacle bottom wall 11 in the upper-lower direction in an area from an intermediate position of the receptacle protruding wall 12 to an intermediate position of the receptacle side wall 14 in the connector width direction (the Y-axis direction). The inner groove 17B is recessed from the side surface (the surface at a right angle to the Y-axis direction) of the receptacle protruding wall 12, and extends in the upper-lower direction. An upper end of the inner groove 17B is closed. On the other hand, a lower end of the inner groove 17B opens and is communicated with the lower groove 17A. The outer groove 17C penetrates the receptacle side wall 14 in the upper-lower direction at an intermediate position in the connector width direction, i.e., in a wall thickness direction of the receptacle side wall 14. A lower end of the outer groove 17C is communicated with the lower groove 17A. The terminal holding groove 17 is configured such that the receptacle terminal 20 is press-fitted in the terminal holding groove 17 from below and is held in the terminal holding groove 17.

The receptacle terminal 20 is formed in such a manner that a metal plate member is punched in a plate thickness direction while a flat plate surface thereof is maintained. The receptacle terminals 20 are arrayed such that the plate thickness direction thereof and the terminal array direction (the X-axis direction) are coincident with each other. The receptacle terminal 20 is press-fitted in the terminal holding groove 17 of the receptacle housing 10, and is held by the terminal holding groove 17. As seen from FIG. 3, the receptacle terminal 20 has a base portion 21 extending straight in the upper-lower direction, a holding target portion 22, an elastic arm portion 23, a coupling arm portion 24, and a connection portion 25. The holding target portion 22 has a smaller width dimension (a dimension in the Y-axis direction) than that of the base portion 21, and upwardly extends straight from an upper end of the base portion 21. The elastic arm portion 23 is positioned inside the holding target portion 22 in the connector width direction, and extends in the upper-lower direction. The coupling arm portion 24 extends in the connector width direction, and couples the upper end of the base portion 21 and a lower end of the elastic arm portion 23. The connection portion 25 extends, from a lower end of the base portion 21, outward in the connector width direction in a substantially crank shape.

The receptacle terminal 20 is press-fitted from below and held in the terminal holding groove 17 of the receptacle housing 10. The base portion 21 in a state in which the receptacle terminal 20 is held by the terminal holding groove 17 is housed in a groove portion positioned outside in the connector width direction in the lower groove 17A. The holding target portion 22 is press-fitted in the outer groove 17C and held by the outer groove 17C in such a manner that a press-fitting protrusion 22A extending in the upper-lower direction in the outer groove 17C and protruding from a side edge portion (an edge portion extending in the upper-lower direction) of the holding target portion 22 bites into an inner surface of the outer groove 17C.

The elastic arm portion 23 extends in the upper-lower direction in the inner groove 17B, and is elastically displaceable in the connector width direction. At an upper end of the elastic arm portion 23, a contact portion 23A protruding outward in the connector width direction is formed. The contact portion 23A protrudes from the inner groove 17B, and is positioned in the receiving portion 16. In the connector fitting state, the contact portion 23A is contactable with the later-described plug terminal 40 of the plug connector 2. The coupling arm portion 24 is housed in a groove portion positioned on an upper side in the lower groove 17A, and extends in the connector width direction. A lower portion of the connection portion 25 extends downward and outward in the connector width direction from the lower groove 17A, and is positioned outside the receptacle housing 10. The connection portion 25 is, at a lower edge of the receptacle housing 10 positioned lower than a bottom surface, soldered to a corresponding circuit portion (not shown) of the circuit board B1 (see FIG. 1).

Next, a configuration of the plug connector 2 will be described. As seen from FIGS. 1 and 2A, the plug connector 2 has a plug housing 30 having a substantially rectangular parallelepiped shape and the multiple plug terminals 40 held by the plug housing 30. The multiple plug terminals 40 are arrayed in two lines in the plug housing 30, a longitudinal direction of the plug housing 30 being taken as the terminal array direction. As seen from FIG. 2A, the plug connector 2 is arranged and mounted on the circuit board B2.

The plug housing 30 is, for example, made of an electric insulating material such as resin. In the plug housing 30, the X-axis direction in the plane (the X-Y plane) parallel to the mounting surface of the circuit board B2 is the longitudinal direction (the terminal array direction), and the Y-axis direction at a right angle to the longitudinal direction is a transverse direction (the connector width direction). The plug housing 30 has a plug bottom wall 31 (see FIG. 1) facing the mounting surface of the circuit board B2 and the plug peripheral wall 33. The plug peripheral wall 33 stands upward (downward in FIG. 1) in FIGS. 2A and 2B, i.e., in the Z2 direction, from a peripheral portion of the plug bottom wall 31.

The plug peripheral wall 33 has a pair of plug side walls 34 extending in the terminal array direction and a pair of plug end walls 35. The pair of plug end walls 35 extends in the connector width direction, and couples end portions of the pair of plug side walls 34. The plug peripheral wall 33 forms the fitting portion to be fitted in the receiving portion 16 of the receptacle connector 1. Moreover, a space surrounded by an inner peripheral surface of the plug peripheral wall 33 and opening upward (downward in FIG. 1) in FIGS. 2A and 2B is formed as a recessed portion 36 for receiving the receptacle protruding wall 12 of the receptacle housing 10.

The multiple plug terminals 40 are, by integral molding, arrayed and held on the plug side walls 34. At the plug end wall 35, an outer surface 35D positioned on the opposite side of an inner surface (a surface forming the recessed portion 36) of the plug end wall 35 in the terminal array direction forms a flat surface at a right angle to the terminal array direction. Moreover, the plug end wall 35 has, at the inner surface thereof, a projecting portion 35A. In a center area in the connector width direction, the projecting portion 35A protrudes inward in the terminal array direction, and extends in the upper-lower direction. The projecting portion 35A is, in the connector fitting state, positioned in an area corresponding to an intermediate area of the receptacle protruding wall 12 of the receptacle housing 10 in the connector width direction. Moreover, as seen from FIG. 2B, the projecting portion 35A extends in the upper-lower direction in an area from a lower end position (an end position on a Z1 side) of the plug end wall 35 to a position (a position closer to a Z2-side end portion) closer to an upper end of the plug end wall 35. Further, the projecting portion 35A is formed to have a smaller dimension in the connector width direction than that of the end surface 12B of the receptacle protruding wall 12.

As seen from FIG. 2B, the projecting portion 35A has a plug end wall first inner surface 35A-1 as a surface forming the inner surface of the plug end wall 35 and a plug end wall second inner surface 35A-2 positioned above (a Z2 side) the plug end wall first inner surface 35A-1 (also see FIG. 3 illustrating the plug connector 2 in a vertically-flipped state). A boundary between the plug end wall first inner surface 35A-1 and the plug end wall second inner surface 35A-2 is, as seen from FIG. 2B, positioned closer to an upper end (closer to a lower end in FIG. 3) of the projecting portion 35A.

As seen from FIG. 5B, the plug end wall first inner surface 35A-1 is formed at a position in an area corresponding to the receptacle protruding wall first end surface 12B-1, specifically the substantially same area as the receptacle protruding wall first end surface 12B-1 in the upper-lower direction, in a state (the connector fitting state) in which the plug connector 2 is fitted in the receptacle connector 1. In the connector fitting state, the plug end wall first inner surface 35A-1 forms such an inclined surface that the plug end wall first inner surface 35A-1 extends along the receptacle protruding wall first end surface 12B-1. That is, in the connector fitting state, the plug end wall first inner surface 35A-1 is inclined outward in the terminal array direction at the same inclination angle as that of the receptacle protruding wall first end surface 12B-1 as extending downward (the Z2 direction). Thus, in the connector fitting state, the receptacle protruding wall first end surface 12B-1 and the plug end wall first inner surface 35A-1 face each other so that these surfaces can surface-contact each other.

As seen from FIG. 5B, it is configured such that the plug end wall second inner surface 35A-2 is positioned in an area corresponding to the receptacle protruding wall second end surface 12B-2 in a state in which the plug connector 2 is fitted in the receptacle connector 1. In the connector fitting state, the plug end wall second inner surface 35A-2 forms such an inclined surface that the plug end wall second inner surface 35A-2 is separated from the receptacle protruding wall second end surface 12B-2 as extending downward (the Z2 direction). That is, in the connector fitting state, the plug end wall second inner surface 35A-2 is inclined outward in the terminal array direction at a greater inclination angle than that of the plug end wall first inner surface 35A-1 as extending downward. Thus, in the connector fitting state, a clearance becoming larger toward a lower side is formed between the receptacle protruding wall second end surface 12B-2 and the plug end wall second inner surface 35A-2.

Moreover, as seen from FIG. 2B, the inner surface of the plug end wall 35 has plug end wall third inner surfaces 35B on both sides of the projecting portion 35A in the connector width direction. The plug end wall third inner surface 35B is inclined at the substantially same inclination angle as that of the plug end wall first inner surface 35A-1. The plug end wall third inner surfaces 35B are positioned outside in the terminal array direction with respect to the plug end wall first inner surface 35A-1 and the plug end wall second inner surface 35A-2 (also see FIG. 6). Thus, even in a case where the plug end wall first inner surface 35A-1 contacts the receptacle protruding wall first end surface 12B-1 in the connector fitting state, a clearance 8 (see FIG. 6) is formed between the plug end wall third inner surface 35B and the end surface 12B of the receptacle protruding wall 12.

Further, as seen from FIG. 2B, at the inner surface of the plug end wall 35, a plug end wall fourth inner surface 35C extending in the connector width direction is formed in an area from an upper end position (a Z2-side end position) of the projecting portion 35A to an upper end position (a Z2-side end position) of the plug end wall 35 in the upper-lower direction. The plug end wall fourth inner surface 35C is formed larger in the connector width direction than the projecting portion 35A.

As seen from FIG. 5B, it is configured such that the plug end wall fourth inner surface 35C is positioned in an area corresponding to the receptacle protruding wall second end surface 12B-2 in a state in which the plug connector 2 is fitted in the receptacle connector 1. In the connector fitting state, the plug end wall fourth inner surface 35C forms such an inclined surface that the plug end wall fourth inner surface 35C is separated from the receptacle protruding wall second end surface 12B-2 as extending downward (the Z2 direction). The inclination angle of the plug end wall fourth inner surface 35C is greater than the inclination angle of the plug end wall second inner surface 35A-2. Thus, as seen from FIG. 5B, in the connector fitting state, a clearance becoming larger toward the lower side is formed between the receptacle protruding wall second end surface 12B-2 and the plug end wall fourth inner surface 35C. Such a clearance is larger than the clearance between the receptacle protruding wall second end surface 12B-2 and the plug end wall second inner surface 35A-2.

The plug terminal 40 is formed in such a manner that a metal band-shaped member is bent in a plate thickness direction. As seen from FIGS. 1 and 2A, the plug terminals 40 are, by integral molding, held on the plug side walls 34 of the plug housing 30 in such an orientation that plate surfaces (surfaces at a right angle to surfaces in the plate thickness direction) of the plug terminals 40 are parallel to the terminal array direction. As seen from FIG. 3, the plug terminal 40 has a holding target portion 41 held by the plug side wall 34 and a connection portion 42. The connection portion 42 extends, in a crank shape, outward in the connector width direction from the plug bottom wall 31 of the plug housing 30. The connection portion 42 is soldered to a corresponding circuit portion (not shown) of the circuit board B2 (see FIG. 2A).

As seen from FIG. 3, the holding target portion 41 is configured such that lower ends of an outer leg portion 41A and an inner leg portion 41B provided parallel to each other and extending in the upper-lower direction are coupled to each other through a coupling portion 41C. The entire shape of the holding target portion 41 is a U-shape. As seen from FIG. 3, the outer leg portion 41A, the inner leg portion 41B, and the coupling portion 41C of the holding target portion 41 each extend along an outer surface, an inner surface, a lower surface of the plug side wall 34. A plate surface of the holding target portion 41 is exposed through each surface of the plug side wall 34.

The inner leg portion 41B is formed as a contact portion with the receptacle terminal 20 of the receptacle connector 1. The inner leg portion 41B can contact the contact portion 23A of the receptacle terminal 20 through a plate surface (a contact surface) exposed through the inner surface of the plug side wall 34. Moreover, at the contact surface of the inner leg portion 41B, a lock recessed portion 41B-1 extending in the upper-lower direction is formed in a recessed shape. In the connector fitting state, the contact portion 23A of the receptacle terminal 20 is positioned in the lock recessed portion 41B-1 so that the contact portion 23A can be locked at a step-shaped edge portion of the lock recessed portion 41B-1. Thus, a lock state for reducing improper detachment of the connectors is ensured.

A dimensional relationship in the terminal array direction between the receptacle connector 1 and the plug connector 2 will be described based on FIG. 5A. In the present embodiment, as seen from FIG. 5A, a distance R from the receptacle protruding wall first end surface 12B-1 on one end side of the receptacle housing 10 in the terminal array direction to the inner surface 15B of the receptacle end wall 15 on the other end side and a distance P from the plug end wall first inner surface 35A-1 on one end side of the plug housing 30 in the terminal array direction to the outer surface 35D of the plug end wall 35 on the other end side is equal to each other at an optional position in the upper-lower direction in the connector fitting state.

Next, connector fitting operation between the receptacle connector 1 and the plug connector 2 will be described.

First, the receptacle connector 1 is mounted on the circuit board B1 by soldering, and the plug connector 2 is mounted on the circuit board B2 by soldering. Next, the plug connector 2 is arranged above the receptacle connector 1 in such an orientation that the recessed portion 36 opens downward. Thus, the receptacle connector 1 and the plug connector 2 are brought into a state right before fitting.

The plug connector 2 in the orientation right before fitting as illustrated in FIG. 1 is, without change, lowered toward the receptacle connector 1. In a case where fitting is started with both connectors being at regular positions, the plug peripheral wall 33 as the fitting portion of the plug connector 2 is, from above, fitted in the annular receiving portion 16 of the receptacle connector 1. Meanwhile, the receptacle protruding wall 12 of the receptacle connector 1 enters the recessed portion 36 of the plug connector 2 from below. In this manner, both connectors 1, 2 are fitted to each other (see FIGS. 5A and 5B). Upon completion of fitting, the contact portions 23A of the receptacle terminals 20 contact, with contact pressure, the inner leg portions 41B as the contact portions of the plug terminals 40 of the plug connector 2 in a state in which the elastic arm portions 23 of the receptacle terminals 20 of the receptacle connector 1 are elastically displaced inward in the connector width direction. As a result, the receptacle connector 1 and the plug connector 2 are in electrical conduction with each other. Moreover, at this point, the contact portion 23A of each receptacle terminal 20 is positioned in the lock recessed portion 41B-1 of the inner leg portion 41B. Thus, the connectors are brought into the lock state.

However, even in a case where the plug connector 2 is in the regular orientation at the regular position right before fitting, the plug connector 2 is not always fitted into the receptacle connector 1 without change. In many cases in an actual situation, the position of the plug connector 2 is slightly shifted in any direction, and both connectors are fitted to each other in a state in which these connectors are inclined to each other. At an upper surface of the plug bottom wall 31 of the plug connector 2, the circuit board B2 (see FIG. 2A) projects in the orientation illustrated in FIG. 1 from the periphery of the plug connector 2. Thus, in many cases, it is difficult to visually check whether or not the fitting state is a regular state. For this reason, a worker performing connector fitting normally lifts one end side of the plug connector 2 in the terminal array direction above the other end side, and therefore, brings the plug connector 2 into an inclined state. Then, the worker lowers the other end side of the plug connector 2 to reliably start fitting from the other end side, and thereafter, also lowers one end side. In this manner, the worker fits the entirety of the plug connector 2 and the entirety of the receptacle connector 1 to each other. As a result, the connector fitting operation is completed, and the electric connector assembly is brought into the connector fitting state.

Moreover, right before fitting, the plug connector 2 in the above-described inclined state might be, in some cases, shifted in the terminal array direction or the connector width direction with respect to the receptacle connector 1. In this case, a portion of the plug connector 2 on the other end side is guided toward the receiving portion 16 along the terminal array direction by the end guide surfaces 15A-1 of the receptacle connector 1, and is guided toward the receiving portion 16 in the connector width direction by the side guide surfaces 14A-1 of the receptacle connector 1.

As seen from FIG. 5B, in the connector fitting state, the clearance becoming larger toward the lower side is formed between the receptacle protruding wall second end surface 12B-2 and the plug end wall second inner surface 35A-2. Moreover, the clearance becoming larger toward the lower side is also formed between the receptacle protruding wall second end surface 12B-2 and the plug end wall fourth inner surface 35C. As seen from FIG. 5B, such a clearance is larger than the clearance between the receptacle protruding wall second end surface 12B-2 and the plug end wall second inner surface 35A-2.

Moreover, as seen from FIG. 6, in the connector fitting state, the clearance 8 is formed between the plug end wall third inner surface 35B of the plug end wall 35 and the end surface 12B of the receptacle protruding wall 12 on each side of the projecting portion 35A of the plug end wall 35 in the connector width direction (the Y-axis direction).

In the present embodiment, on one end side in the terminal array direction, the receptacle protruding wall first end surface 12B-1 formed at the receptacle protruding wall 12 and the plug end wall first inner surface 35A-1 formed at the plug end wall 35 both form the inclined surfaces. Thus, when one end side of the plug connector 2 is lowered to rotate about the other end side after fitting on the other end side has progressed to a certain extent, the receptacle protruding wall first end surfaces 12B-1 and the plug end wall first inner surfaces 35A-1 smoothly progress fitting.

Moreover, in the present embodiment, upon use of the electric connector assembly, i.e., when the connectors 1, 2 are in the fitting state, the distance R from the receptacle protruding wall first end surface 12B-1 on one end side of the receptacle housing 10 in the terminal array direction to the inner surface 15B of the receptacle end wall 15 on the other end side and the distance P from the plug end wall first inner surface 35A-1 on one end side of the plug housing 30 in the terminal array direction to the outer surface 35D of the plug end wall 35 on the other end side are equal to each other at the optional position in the upper-lower direction (see FIG. 5A).

Thus, when the position of the plug connector 2 with respect to the receptacle connector 1 is, due to, e.g., careless dropping of the electric connector assembly, shifted from the regular position to the other end side in the terminal array direction in the connector fitting state, the plug end wall first inner surface 35A-1 contacts (surface-contacts) the receptacle protruding wall first end surface 12B-1 on one end side. At the same time, the outer surface 35D of the plug end wall 35 also contacts (surface-contacts) the inner surface 15B of the receptacle end wall 15 on the other end side. As a result, the force of contact between the plug housing 30 and the receptacle housing 10 is received dispersedly by both positions on one end side and the other end side. Thus, in the present embodiment, the force received by each position is smaller as compared to a typical case where the force of contact between housings is received by a single position. Thus, it is less likely to damage the plug end walls 35 and the receptacle protruding wall 12.

Further, in the present embodiment, the clearance becoming larger toward the lower side is, as described above, formed between the receptacle protruding wall second end surface 12B-2 of the receptacle connector 1 and each of the plug end wall second inner surface 35A-2 and the plug end wall fourth inner surface 35C of the plug connector 2 in the connector fitting state. On this point, when the plug connector 2 is wrenched in the terminal array direction upon connector detachment, a lower portion of the plug end wall 35 is greatly displaced (moved) in the terminal array direction. Even in this case, in the present embodiment, the great clearances are formed, and therefore, the receptacle protruding wall second end surface 12B-2 is less likely to contact the plug end wall second inner surface 35A-2 and the plug end wall fourth inner surface 35C. Thus, it is less likely to damage the plug end walls 35 and the receptacle protruding wall 12. Note that in the present embodiment, the plug end wall 35 also has the plug end wall fourth inner surface 35C in addition to the plug end wall second inner surface 35A-2. On this point, formation of the plug end wall fourth inner surface 35C at the plug end wall 35 is not essential.

In addition, in the present embodiment, the clearance 8 is, as described above, formed between the plug end wall third inner surface 35B of the plug end wall 35 and the end surface 12B (the receptacle protruding wall first end surface 12B-1 and the receptacle protruding wall second end surface 12B-2) of the receptacle protruding wall 12 on each side of the projecting portion 35A of the plug end wall 35 in the connector width direction in the connector fitting state. Thus, in the connector fitting state, even in a case where the external force of causing rotation about an axis extending in the upper-lower direction acts on the plug connector 2, the plug end wall third inner surface 35B of the plug end wall 35 is less likely to contact the end surface 12B of the receptacle protruding wall 12. Consequently, it is less likely to damage the plug end walls 35 and the receptacle protruding wall 12.

As described above, in the present embodiment, the inner grooves 17B for housing the elastic arm portions 23 of the receptacle terminals 20 are formed and arrayed in the terminal array direction at the side surfaces 12A of the receptacle protruding wall 12. As seen from FIG. 6, the inner grooves 17B positioned at the outermost end in the terminal array direction are formed in the vicinity of the end surface 12B of the receptacle protruding wall 12. Thus, the thickness dimension S (a dimension in the terminal array direction) of a wall portion (hereinafter referred to as a "corner wall portion 12C" (see FIG. 6)) between each inner groove 17B positioned at the outermost end and the end surface 12B of the receptacle protruding wall 12 is not so great.

Suppose that no projecting portion 35A is provided at the plug end wall 35. In this case, when the inner surface of the plug end wall 35 and the receptacle protruding wall first end surface 12B-1 contact each other, these surfaces surface-contact each other across the entire area in the connector width direction. Moreover, when the external force of causing rotation about the axis extending in the upper-lower direction acts on the plug connector 2 in a state in which the inner surface of the plug end wall 35 and the receptacle protruding wall first end surface 12B-1 surface-contact each other in such an area, external force having an inward component in the terminal array direction from the inner surface of the plug end wall 35 acts on the corner wall portion 12C. Thus, the corner wall portion 12C is deformed inward in the terminal array direction, and the groove width of each inner groove 17B positioned at the outermost end is narrowed. As a result, the elastic arm portion 23 of the receptacle terminal 20 housed in the inner groove 17B is clamped by an inner wall surface of the inner groove 17B. This interferes with free elastic displacement of the elastic arm portion 23. This might provide an adverse effect on the state of contact between the receptacle terminal 20 and the plug terminal 40.

On the other hand, in the present embodiment, the projecting portion 35A is provided at the plug end wall 35. Moreover, on each side of the projecting portion 35A, the clearance 8 is formed between the plug end wall third inner surface 35B of the plug end wall 35 and the end surface 12B of the corner wall portion 12C of the receptacle protruding wall 12. Thus, even in a case where the external force of causing rotation about the axis extending in the upper-lower direction acts on the plug connector 2, the plug end wall third inner surface 35B is less likely to contact the end surface 12B of the corner wall portion 12C. Thus, deformation of the corner wall portion 12C is reduced. As a result, a favorable state of contact between the receptacle terminal 20 and the plug terminal 40 can be ensured.

In the present embodiment, the receptacle protruding wall second end surface of the receptacle connector is the surface parallel to the upper-lower direction, and is not inclined. Instead, the receptacle protruding wall second end surface may be a surface inclined with respect to the upper-lower direction. In this case, the receptacle protruding wall second end surface is formed as such an inclined surface that the receptacle protruding wall second end surface is inclined to an inner surface side of the receptacle end wall at a smaller inclination angle than that of the receptacle protruding wall first end surface as extending downward. Even in a case where the receptacle protruding wall second end surface is formed as such an inclined surface, a clearance can be formed between the receptacle protruding wall second end surface and the plug end wall second inner surface. Thus, damage of the plug end walls 35 and the receptacle protruding wall 12 can be reduced.

Moreover, in description above, in a case where there are expressions such as "vertical," "right angle," "perpendicular," "parallel," and "plane," these expressions do not precisely mean "vertical," "right angle," "perpendicular," "parallel," and "plane." That is, these expressions of "vertical," "right angle," "perpendicular," "parallel," and "plane" accepts a tolerance and an error in design and manufacturing, and each mean "substantially vertical," "substantially right angle," "substantially perpendicular," "substantially parallel," and "substantially plane."

Further, in description above, in a case where there are expressions such as "same," "identical," "equal," and "different" regarding a dimension, a size, a shape, a position and the like in terms of appearance of a member, these expressions do not precisely mean "same," "identical," "equal," "different," and the like. That is, these expressions of "same," "identical," "equal," and "different" accepts a tolerance and an error in design and manufacturing, and each mean "substantially same," "substantially identical," "substantially equal," and "substantially different."

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An electric connector assembly comprising:

a receptacle connector arranged on a mounting surface of a circuit board; and a plug connector arranged on another circuit board, wherein the plug connector is, from above, fitted in and connected to the receptacle connector, an upper-lower direction in which the circuit boards face each other being taken as a connector insertion/detachment direction, the receptacle connector includes a receptacle housing, the receptacle housing has a peripheral wall and a receptacle protruding wall standing upward from a bottom wall in the peripheral wall, the peripheral wall is formed by a pair of receptacle side walls standing upward from a peripheral portion of the bottom wall facing the mounting surface of the circuit board and extending in a longitudinal direction of the receptacle housing and a pair of receptacle end walls coupling, in a transverse direction at a right angle to the longitudinal direction, end portions of the pair of receptacle side walls in the longitudinal direction, a space surrounded by an inner peripheral surface of the peripheral wall and an outer peripheral surface of the receptacle protruding wall is formed as a receiving portion for receiving the plug connector from above, the plug connector includes a plug housing, the plug housing has a fitting portion to be fitted in the receiving portion from above, the fitting portion has a pair of plug side walls extending in the longitudinal direction and a pair of plug end walls coupling, in the transverse direction, end portions of the pair of plug side walls in the longitudinal direction, each of outer surfaces of the receptacle protruding wall positioned on one end side and the other end side in the longitudinal direction has a receptacle protruding wall first end surface positioned on an upper end side and a receptacle protruding wall second end surface positioned below the receptacle protruding wall first end surface, the receptacle protruding wall first end surface is inclined with respect to the upper-lower direction toward an inner surface side of a corresponding one of the receptacle end walls as extending downward, the receptacle protruding wall second end surface is inclined at a smaller inclination angle than that of the receptacle protruding wall first end surface, or extends parallel to the upper-lower direction, in a connector fitting state in which the plug connector is fitted in the receptacle connector, an inner surface of each plug end wall has a plug end wall first inner surface positioned in an area corresponding to the receptacle protruding wall first end surface and a plug end wall second inner surface positioned in an area corresponding to the receptacle protruding wall second end surface, the plug end wall first inner surface is inclined to extend along the receptacle protruding wall first end surface, the plug end wall second inner surface is inclined to separate from the receptacle protruding wall second end surface as extending downward, and in the connector fitting state, a distance from the receptacle protruding wall first end surface on one end side of the receptacle housing in the longitudinal direction to the inner surface of the receptacle end wall on the other end side and a distance from the plug end wall first inner surface on one end side of the plug housing in the longitudinal direction to an outer surface of the plug end wall on the other end side are equal to each other at an optional position in the upper-lower direction.

2. The electric connector assembly according to claim 1, wherein each plug end wall has a projecting portion protruding toward the receptacle protruding wall in an area corresponding to an intermediate area of the receptacle protruding wall of the receptacle housing in the transverse direction in the connector fitting state, and the plug end wall first inner surface and the plug end wall second inner surface are formed at the projecting portion.

3. The electric connector assembly according to claim 2, wherein the projecting portion is formed to have a smaller dimension in a connector width direction than that of each outer surface of the receptacle protruding wall.

4. The electric connector assembly according to claim 2, wherein the inner surface of each plug end wall has plug end wall third inner surfaces on both sides of the projecting portion in the connector width direction, and the plug end wall third inner surfaces are, in the connector fitting state, positioned outside the plug end wall first inner surface and the plug end wall second inner surface in the longitudinal direction.

5. The electric connector assembly according to claim 3, wherein the inner surface of each plug end wall has plug end wall third inner surfaces on both sides of the projecting portion in the connector width direction, and the plug end wall third inner surfaces are, in the connector fitting state, positioned outside the plug end wall first inner surface and the plug end wall second inner surface in the longitudinal direction.

6. The electric connector assembly according to claim 4, wherein each plug end wall third inner surface is, in the connector fitting state, positioned with a clearance in the longitudinal direction from a corresponding one of the outer surfaces of the receptacle protruding wall.

7. The electric connector assembly according to claim 6, wherein each plug end wall third inner surface is, in the connector fitting state, positioned with a clearance in the longitudinal direction from a corresponding one of the outer surfaces of the receptacle protruding wall.

* * * * *